United States Patent [19]

Tassone et al.

[11] 3,933,241

[45] *Jan. 20, 1976

[54] PACKAGE CONSTRUCTION

[76] Inventors: Joseph V. Tassone, 2425 Rawnsdale Road, Kettering, Ohio 45440; James T. Candor, 5440 Cynthia Lane, Dayton, Ohio 45429

[ * ] Notice: The portion of the term of this patent subsequent to June 25, 1991, has been disclaimed.

[22] Filed: Dec. 11, 1973

[21] Appl. No.: 423,705

[52] U.S. Cl. ..... 206/223; 206/315

[51] Int. Cl.[2] ..... B65D 69/00; B65D 85/00

[58] Field of Search ..... 206/223, 315, 461, 102, 206/45.24; 248/44, 46, 174, 459, 108; 211/14; 273/26 R, 202; 40/124.1

[56] References Cited

UNITED STATES PATENTS

| | | | |
|---|---|---|---|
| 1,657,381 | 1/1928 | Everson | 248/459 |
| 2,555,986 | 6/1951 | Miller | 206/45.24 |
| 2,693,358 | 11/1954 | Dawson, Jr. | 248/44 |
| 2,795,386 | 6/1957 | Elsey | 248/174 |
| 2,890,790 | 6/1959 | Gibson, Jr. | 206/315 |
| 2,930,615 | 3/1960 | Cowan | 206/102 |
| 2,976,041 | 3/1961 | White | 273/202 |
| 3,285,550 | 11/1966 | Smith | 248/46 |
| 3,416,656 | 12/1968 | Addiego | 206/461 |
| 3,650,407 | 3/1972 | Benham, Jr. | 248/108 |

*Primary Examiner*—William T. Dixson, Jr.
*Attorney, Agent, or Firm*—Candor, Candor & Tassone

[57] ABSTRACT

A package construction is provided and includes a collapsible tee member for supporting a ball in an upright manner to be hit by a bat when the tee member is erected and one of a bat and ball is held by the tee member to form therewith a self-contained package construction by the tee member being held in a collapsed condition.

8 Claims, 10 Drawing Figures

PACKAGE CONSTRUCTION

CROSS-REFERENCE TO RELATED APPLICATIONS

This application is related to applicants' copending patent applications, Ser. No. 320,206, now U.S. Pat. No. 3,819,038; and Ser. No. 326,805, now U.S. Pat. No. 3,830,362.

BACKGROUND OF THE INVENTION

Ball games, such as baseball, softball, and the like are played throughout the world and particularly in the United States by young ball players starting at roughly age 5 and continuing through the teen years to adulthood. Young ball players often have a wide assortment of baseball and softball type ball bats which include wooden bats, metal bats, lightweight plastic bats, and the like which may be used with either regulation balls or lightweight balls made of plastic or other elastomeric material. The lightweight balls often have holes or other devices provided as a part thereof to prevent such balls from being hit comparatively large distances whereby such balls may be used in small yards, inside gymnasiums, and other recreational areas.

In general, it is difficult for a player to improve his batting skills while playing alone and various devices including comparatively expensive ball toss-up mechanisms, complicated tees, tees which have rotary ball moving mechanisms, and the like have been proposed heretofore for the purpose of helping a young ball player improve his or her batting skill. Categorically, most of these previously proposed devices are comparatively expensive and many of such devices are too complicated for use by a young ball player under about 10 years of age.

SUMMARY

This invention provides an improved economical package construction comprising a collapsible tee member for supporting a ball in an upright manner to be hit by a bat when the tee member is erected, and one of a bat and a ball being held by the tee member to form therewith a self-contained package construction by the tee member being in a collapsed condition thereof. The tee member is particularly adapted to support a ball in a ball strike zone which is at least equal to a vertical height defined by a batter's knees and such vertical height may range between a batter's knees and his or her armpits as is well known in baseball and softball as played in the United States.

Other details, uses, and advantages of this invention will be readily apparent from the exemplary embodiments thereof presented in the following specification, claims, and drawing.

BRIEF DESCRIPTION OF THE DRAWING

The accompanying drawing shows present preferred embodiments of this invention, in which.

DETAILED DESCRIPTION

Figure 1:
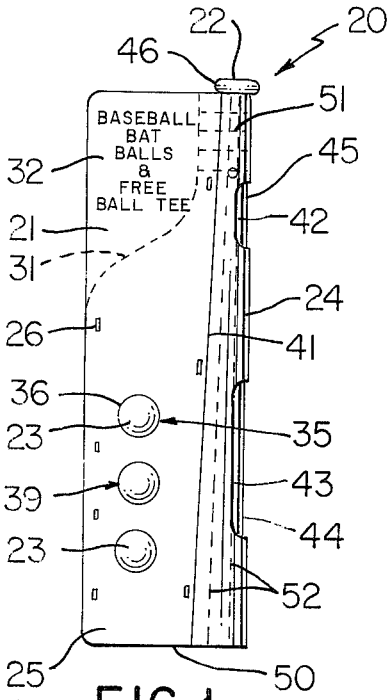
FIG. 1 is a view in elevation illustrating one exemplary embodiment of a package construction of this invention comprised of a comparatively inexpensive collapsible ball tee member, a ball bat, and a plurality of three balls.

Reference is now made to FIG. 1 of the drawing which illustrates one exemplary embodiment of a package construction which is designated generally by the reference numeral 20 and is comprised of a collapsible tee member 21 for supporting a ball thereon in an upright manner so that it may be readily hit by a ball bat when such tee member is erected and the package construction 20 includes a ball bat 22 and a plurality of three balls each designated by the same reference numeral 23. The tee member 21 is comprised of a columnar tubular portion 24 which is suitably sized and constructed of a material so that it may be readily and easily placed in surrounding relation around the ball bat 22 whereby the bat 22 is, in essence, telescoped therein.

The tee member 21 has two hinged parts or side wings 25 on opposite sides of the tubular portion 24 and in FIG. 1 the wing portions 25 are fastened together flatly against each other by any suitable means such as staples 26, or the like. Once the fastening means or staples 26 are removed the wing portions 25 of the tee are folded outwardly to the configuration illustrated in FIG. 2 and the bat 22 and balls 23 removed therefrom whereupon a ball 23 may be placed on a top substantially annular surface 30 defined by the top edge of the columnar portion 24 so that such ball may be readily struck by a ball bat.

To facilitate easy striking and an essentially unobstructed view of the ball 23, each wing portion 25 of the tee 21 may be provided with a weakened line of separation such as a perforated line 31 defining an upper portion 32 thereof. Once portion 32 of each wing portion 25 is severed away along its line 31, the tee will have the appearance illustrated in FIG. 3. It will be appreciated that a ball 23 supported on tee 21 may be struck by a bat by striking in the direction of the arrow 33, in the direction of the arrow 34, or in any other direction including perpendicular to the directions 33 and 34.

Figure 2:
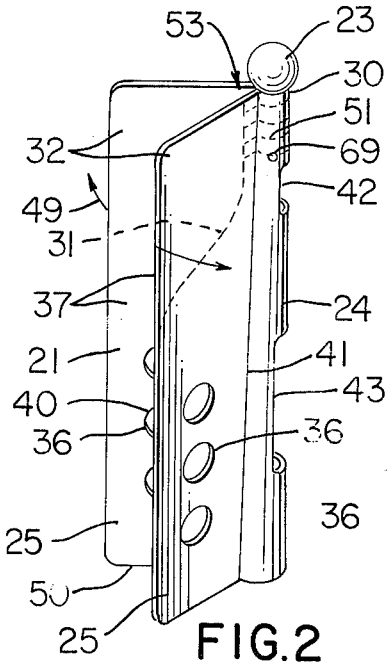
FIG. 2 is a perspective view illustrating the tee member of FIG. 1 in its erected condition and shown supporting a ball thereon so that it may be struck by a ball bat.
Figure 3:
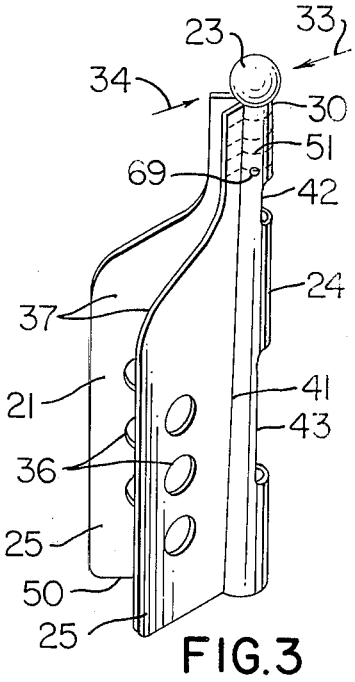
FIG. 3 is a view similar to FIG. 2 and illustrating upper portions of the tee member severed away along weakened lines of separation so that the ball provides a more distinct target.

As seen particularly in FIGS. 1–3 of the drawings the tee member 21 has integral means for holding the balls 23 therewith when the tee member 21 is in a folded condition. In particular, it can be seen that such holding means is designated generally by the reference numeral 35 and comprises a pair of aligned equal-size openings 36 in the hinged parts or wing portions 25 for each ball 23. The openings 36 of each pair are arranged in aligned relation once the wing portions are folded with their inside surfaces 37 against each other and each opening 36 is smaller than the maximum diameter of a ball 23 whereby when the parts 25 are folded against each other and the tee is fastened by staples 26 or the like, in its collapsed condition (as shown in FIG. 1) the balls 23 are trapped by the annular portions 40 of surfaces 37 adjoining the openings 36 whereby portions of each ball, shown at 39, project outwardly from the outside surface of each hinged wing portion 25. The dimensions of each ball 23, openings 36, etc. are such that with the portions 25 stapled together the balls 23 cannot be removed except by unfastening such staples.

The tee member 21 may be provided with a pair of rectilinear fold lines 41 about which the hinged parts 25 are foled or hinged, and, the tubular portion 24 may be a comparatively smooth tubular portion. Further, the tubular portion 24 may be provided with a plurality of openings 42 and 43 therein to enable easy inspection of the bat 22 of the package construction 20 therethrough without the need to disassemble the package construction 20 for inspection purposes.

The bat 22 may be made so that it has a comparatively large diameter hitting end portion 44 and a smaller diameter handle portion 45 provided with the usual knob 46 at the terminal end of the handle portion 45. Once the tee member 21 is wrapped with its tubular portion 24 around the bat, the knob portion 46 at the terminal end of the handle of the bat prevents the bat from moving in one direction while the larger diameter hitting end portion 44 prevents the bat from moving in the opposite direction whereby such bat is effectively axially trapped or packaged in the package 20. Further, once the hinged parts 25 are suitably fixed by staples 26 in position with the balls 23 within their openings 36 the unitary package 20 is merely defined of merely balls 23, a bat 22, and a tee member 21 without requiring any additional packaging materials whereby the package is of optimum simplicity and maximum economy.

The tee member 21 is such that it supports an associated ball 23 for striking by a batter at a vertical height above the base or bottom portion 50 thereof in ball strike zone which is at least equal to the vertical height defined by the batter's knees. It is well known in baseball and softball that the ball strike zone in the case of a ball pitched by a pitcher is defined by the width of home plate and a vertical zone defined between the batter's knees and the batter's armpits whereby the tee member 21 would be used to similarly position a ball 23. Preferably the height of the tee is such that it will support a ball 23 thereon approximately at waist or belt-buckle height which is normally above 2 feet in height for a young 5-year-old ball player. To provide additional control of the height at which a ball may be supported, the tee member 21 may be provided with a plurality of suitably axially or vertically spaced apart marks 51 which represent locations at which the tee 21 may be out off so that it may be, in effect, customized for a particular batter.

The tubular portion 24 of the tee member 21 may be a comparatively rigid tubular portion having the bend lines 41 on opposite sides thereof and such tubular portion may be constructed of a suitable material so that its parts 25 may be spread outwardly as indicated by the arrows 48 in FIG. 2 and the bat slipped in position by spreading the area at 53 without damaging the tubular portion 24.

However, it will be appreciated that it is entirely within the scope of this invention to provide the tubular portion 24 with spaced roughly parallel axially extending bend lines shown by dotted lines 52 at various locations about the periphery thereof so that winged portions 25 may be spread apart as before and tubular portion 24 also spread apart to facilitate insertion of the bat 22 therewithin. Nevertheless, once hinged parts 25 are released even with bend lines or weakening means 52 the tubular portion 24 is still capable of providing adequate support for a ball and can still take substantial abuse.

Figure 4:
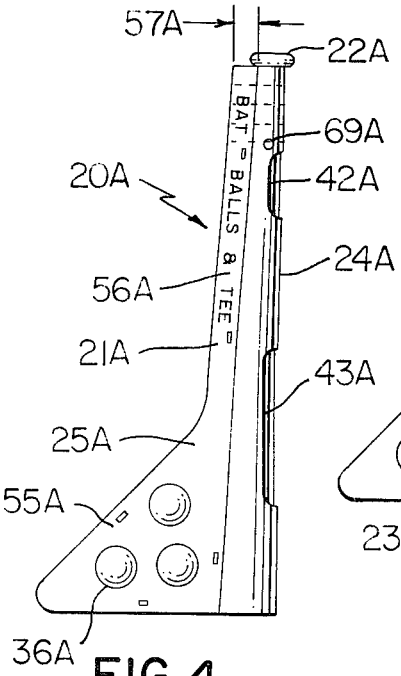
FIG. 4 is a view similar to FIG. 1 illustrating another embodiment of the package construction of this invention which utilizes another type of tee member.
Figure 6:
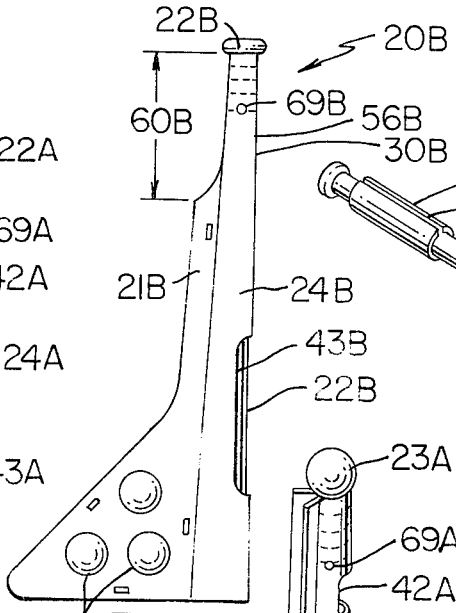
FIG. 6 is a fragmentary perspective view of another exemplary embodiment of the package construction of this invention.
Figure 5:
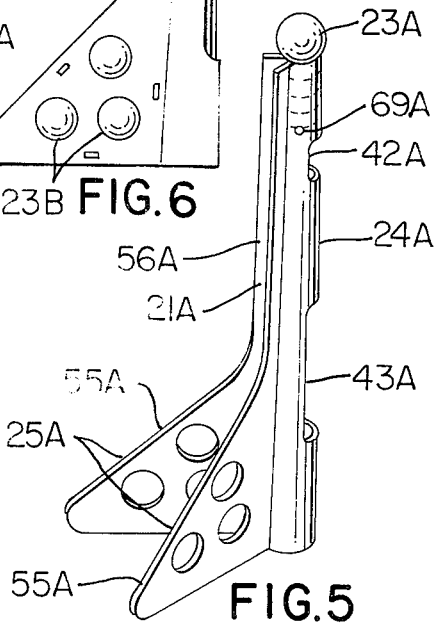
FIG. 5 is a perspective view similar to FIG. 2 illustrating the tee member of FIG. 4 in its erected condition.

Other exemplary embodiments of the package construction of this invention are illustrated in FIGS. 4–5 and 6. The package constructions illustrated in FIGS. 4–5 and 6 are similar to the package construction 20; therefore, such package constructions will be designated by the reference numerals 20A and 20B respectively and representative parts of each package construction which are similar to corresponding parts of the package 20 will be designated in the drawing by the same reference numeral as in the package construction 20 (whether or not such component parts are mentioned in the specification) followed by the associated letter designation either A or B. Only those component parts of each package construction which are substantially different from corresponding parts of the package 20 will be designated by a new reference numeral also followed by the associated letter designation and described in detail.

The main difference between the package construction 20A and the package construction 20 is that the tee member 21A uses considerably less material and its opposed wing-like or hinged parts 25A each has a roughly triangular base portion 55A which is approximately an isosceles triangle and three openings 36A are provided entirely within each triangular base portion 55A and in an approximately triangular pattern. In addition, the hinged parts 25A have upwardly extending portions 56A of comparatively narrow dimension as indicated at 57A whereby a minimum of material is employed in making the tee member 21A whereby such tee member can be made of a comparatively more durable and, if required, more expensive material. It will also be seen that the tubular portion 24A has openings 42A and 43A therein for inspection of an associated bat 22A carried therein.

The package construction 20B of FIG. 6 has a tee member 21B, a bat 22B, and a plurality of three balls 23B and is very similar to the package construction 20A with the exception that the tee member 21B has a substantial height 60B of its upper portion 56B removed so that the upper portion of the tee member 21B is, in essence, substantially completely tubular, whereby a ball supported on the substantially annular top portion 30B thereof may be struck by a bat with the tee member oriented in any direction and without concern that the upper portion of such tee member might be struck with the bat. It will be seen that in this modification, only lower opening 43B is provided for inspection of the bat 22B to give more rigidity to the upper part of the tubular portion 24B.

Figure 8:
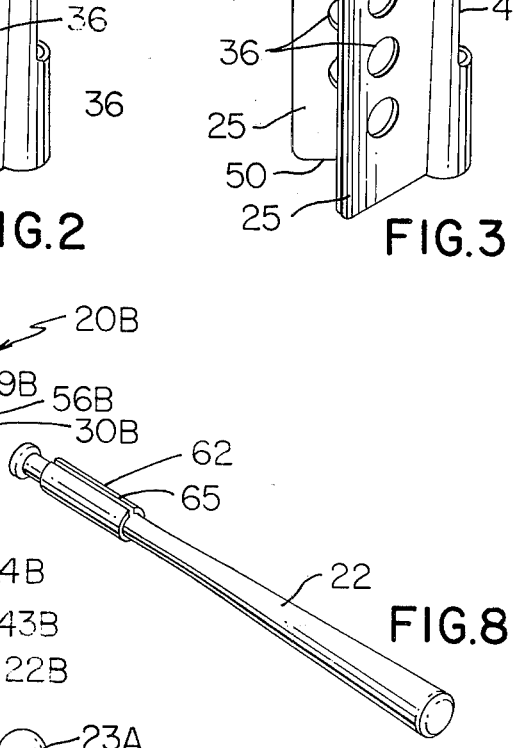
FIG. 8 is a view showing the height adjustment member of FIG. 7 supported concentrically around the handle of a ball bat prior to placing the bat within the tee of its associated package construction.
Figure 7:
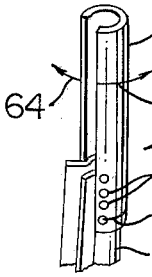
FIG. 7 is a fragmentary perspective view illustrating a telescoping height adjustment member which may be used with either the tee shown in FIG. 1 or the tee shown in FIG. 4 to enable adjusting the position of a ball on the tee at an infinite number of positions.

Each of the tee members or tees 21, 21A, or 21B instead of being provided with marks 51, 51A, or 51B respectively to enable severing the top portion of the tee member for ball height adjustability may be provided with a telescoping ball height adjustment element and such an element is illustrated in FIGS. 7 and 8 of the drawing and designated by the reference numeral 62.

The height adjustment member or element 62 may be used on tee members 21 or 21A in the manner illustrated at 63 in FIG. 8 and is constructed of a suitable material so that it serves as a resilient C-type clamp which is spread apart as indicated by the arrows 64. With element 62 spread apart it may be moved axially and placed at the desired vertical location along the tubular portion, either 24 or 24A, and then released whereby it clampingly engages its associated tee member and may be held firmly in position by friction.

The height adjustment element 62 is preferably packaged with the bat by spreading such member apart along its open vertical height shown at 65 and then allowing it to embrace the handle portion of the bat whereupon the bat with the element 62 in position is then suitably installed into position in its tubular portion, either 24, 24A or 24B, of its associated package construction 20, 20A, or 20B respectively.

Figure 9:
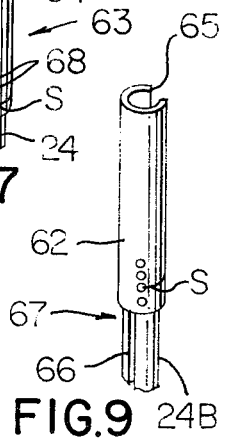
FIG. 9 is a view showing the height adjustment member of FIG. 7 used on the tee of the package construction of FIG. 6.

The height adjustment element 62 when used with the tee member 21B is preferably turned around so that its open portion 65 is diametrically opposite the open portion 66 in the tubular tee member 24B as illustrated at 67 in FIG. 9. Further, each height adjust element 62 may be provided with a plurality of sets of vertically spaced openings therein each designated 68 so that two openings of a particular set of openings may be aligned with a cooperating opening 69 in the tubular portion of a tee member either portion 24, 24A, or 24B of members 21, 21A, or 21B and a fastener such as a string S passed through the aligned openings to attach the height adjust member more firmly in position.

The tee members 21, 21A, and 21B may be made of any suitable material including cheap, discardable, comparatively inexpensive materials such as paper whereby each tee member such as tee member 21 may be in the form of a free tee member given away as an incentive for a purchaser to buy the ball bat and for a ball.

However, the tee members 21, 21A, and 21B may be made of any suitable material including comparatively durable elastomeric materials including plastics, rubber compounds and the like. Further, the tee members 21, 21A, and 21B are preferably made so that if they are knocked over, persons falling thereon tend to easily collapse the tees thereby avoiding injury to such person because the tees would be flattened into a substantially flat configuration. Once the weight of a person is removed each of the tees 21, 21A, or 21B could be such that it assumes the configuration shown in FIGS. 2, 3, 5, and 6 for example.

As previously indicated, each tee member is constructed so that it supports a ball such as a softball or a baseball in a ball strike zone which is at a vertical height at least equal to the height of a batter's knees whereby the height of each tee is at least generally in the order of about 2 feet. In contrast to this the base of such a tee member is comparatively small considerably less than 1 foot and preferably of the order of about 8 inches whereby each of the tees is comparatively readily knocked over and this is a desirable feature.

Further, each of the tees comprising the package construction of this invention is preferably made of a lightweight material of the type disclosed above whereby a ball player missing the ball and hitting a part of the tee (as often occurs in using tees of this type) would not be subjected to a stinging sensation whereby there would be no reluctance on the part, especially a young ball player, to use the tee of this invention.

Each package construction of this invention with its unique tee member may be used to package regulation baseballs, softballs, and bats. Further, each package construction may be used to package and sell bats and balls made of plastic and of the toy variety.

The tee members comprising the package construction of this invention may be very durable and capable of withstanding repeated striking by a ball bat by an entire ball team playing tee-ball for one or more seasons, or may be of the free variety which may be given away as incentive to purchase a bat and/or a ball whereby such free tees need not be so durable.

In particular, should any of the tee members of this invention be formed of relatively thin cardboard or other deformable material or the like, the same could be formed initially from a flat blank of material suitably cut and scored to readily form into the tee member of this invention as the same is being assembled with the bat and balls to be packaged therewith.

Figure 10:
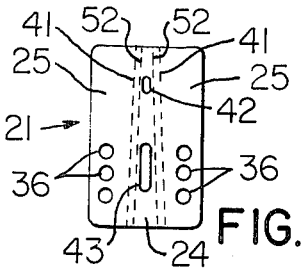
FIG. 10 is a plan view of a blank of this invention for forming the tee member of FIG. 1.

For example, reference is now made to FIG. 10 wherein a flat blank of cardboard or the like of this invention is to be utilized to form the tee member 21 of FIG. 1 and it is to be realized that similar blanks can be provided for forming the tee members 21A and 21B previously described in a like manner.

As illustrated in FIG. 10, the flat blank is substantially rectangular and has precut therein the openings 36, 42 and 43 and is provided with the hinge lines 41 and one or more weakening lines 52 so that when a bat 22 is subsequently placed on the central portion of the blank of FIG. 10, and balls 23 are placed in one set of openings 36, the flat blank of FIG. 10 can be then wrapped around such bat by bringing the wings 25 thereof toward each other so that the tubular portion 24 of the tee member 21 will automatically form around the bat 22 to capture the same therewith in the telescoping manner previously described and the balls 23 will likewise be captured by the aligned openings 36 in the wings 25 as the same are stapled together by the staples 26 previously described.

However, if the material forming the blank of FIG. 10 is sufficiently deformable, it may be found that weakening lines 52 and hinge lines 41 can be eliminated and that the blank will automatically form its tubular configuration during the assembly operation with the bat 22 and balls 23 in the manner previously described.

Thus, it can be seen that this invention not only provides an improved package construction, but also this invention provides an improved method for making such a package construction as the tee member forming part of the package construction can be automatically formed from a simple flat blank in a unique manner.

Also, while the tubular portion 24 of the tee member 21 and other tee members of this invention has been illustrated and described as being tapering in a manner to substantially conform to the contour of the associated bat 22, it is to be understood that such tubular portions 24 could be uniform throughout the length thereof and merely trap the associated bat by friction in its telescoping relation therewith.

In addition, while the wings 25 for the tee member 21 and other tee members of this invention have been described as substantially automatically springing back into the erect condition of FIG. 2 after the tee member 24 has been knocked over and a person has fallen on the same to collapse the wing members 25 in a safe manner, it is to be understood that the hinge lines 41 for the wings 25 may be so constructed and arranged that when the tee member 24 is knocked over, the wing members 25 automatically collapse toward each other into a flat condition so that the major protruding portions of the tee members 24 will be in a flat condition to prevent tripping, etc., of the user thereof so that when the tee member 24 is again placed in an upright manner, the user merely folds out the wings 25 to the desired angular position, such as illustrated in FIG. 2, to support the tee member 21 in its erect condition.

Thus, it can be seen that the lower portions of the wings 25 and the lower portion of the tubular member 24, in effect, form the base for the remainder of the tee member 21 so that when the same is knocked over, substantially the major portion of the base of such tee member 21 automatically collapses to a flat out-of-the-way condition.

Accordingly, it can be seen that the wings 25 for the tee member 21, as well as the wing members for the other tee members of this invention, provide a base supporting function for the tee member as well as a ball attaching function for the package construction.

It will also be appreciated that the wing members 25 for the tee member 21 provides advertising space for the manufacturer of the package construction of this invention.

Since the tee members of this invention can be made of relatively cheap materials, the same would be subject to adverse air currents in outdoor tee-ball play that would tend to blow over such tee members in the erect condition thereof. However, because the openings 36 are provided through the wing members 25, and the openings 42 and 43 are formed through the tubular portion 24 thereof, it can be seen that the tee members of this invention are less air resistant than uncut materials of the same size.

Also, it may be found that the upper portions of the wings 25 adjacent the top of the tubular portion 24 of the tee member 21 of this invention can be utilized to guide and/or control the flight of the ball 23 hit therefrom through the configuration of the top portions of the wings 25 and/or the top portion of the tubular portion 24. For example, by merely angularly cutting the same, pop flies might be assured by a person striking the ball 23 in a normal manner from the tee member 24. Other types of flight control may also be provided, such as grounders, foul balls, and the like.

If desired, the tubular or columnar part of each of the tee members of this invention can be treated differently than the wing members thereof to render the tubular portions more durable. For example, the blank for forming a tee member of this invention can have the area thereof that forms the tubular part of the tee member reinforced by having additional material laminated thereto or be impregnated with plastic material and the like to render the same more durable, as desired.

It is also conceivable that the tubular part of the tee members of this invention could be a separate part from the wing members which are subsequently attached thereto in any desired manner whereby the tubular part could be made of different or the same material as the material of the wing members.

Thus, it is seen that package construction is provided by this invention comprising a tubular baseball and softball tee member, and a bat for hitting a ball off of the tee member. The bat is telescoped into the tee member and is of a generally conventional baseball and softball type ball bat configuration. Further, means may be provided for detachably securing a ball to one end portion of the tee member and such means may be utilized for subsequently forming a base means for the tee member so that the tee member can be set in an upright manner on such base means.

While present exemplary embodiments of this invention, and methods of practicing the same, have been illustrated and described, it will be recognized that this invention may be otherwise variously embodied and practiced within the scope of the following claims:

What is claimed is:

1. A package construction comprising a collapsible baseball and softball tee member for supporting a ball to be hit by a baseball and softball type ball bat when said tee member is erected whereby said tee member in said erected condition thereof is adapted to support a ball for striking by a batter at a vertical height which is at least equal to the vertical height defined by the batter's knee, and one of a baseball and softball type ball bat and ball being held by said tee member disposed thereabout in a collapsed condition and forming therewith a self-contained package construction.

2. A package construction as setforth in claim 1 wherein said one of said bat and said ball comprises a baseball and softball type ball bat, said tee member having a part thereof that is folded about said bat, said part of said tee member substanitally being wrapped about the periphery of said bat.

3. A package construction as set forth in claim 4 and further comprising a ball and wherein said tee member has means for also holding said ball therewith when said tee member is in its folded condition about said bat.

4. A package construction as set forth in claim 3 wherein said means of said tee member for holding said ball comprises opening means in said tee member.

5. A package construction as set forth in claim 4 wherein said tee member has two parts hinged together to form a hinge area thereof so that said tee member will fold about said bat at said hinged area of said parts when said tee member is in its folded condition, said parts when unfolded away from each other a certain amount permitting said tee member to be supported by said parts in an erect manner with said hinged area providing a columnar means to support said ball adjacent the top of said columnar means.

6. A package construction as set forth in claim 5 wherein said parts of said tee member have said opening means therein in aligned relation when said parts are folded toward each other, said opening means being smaller than said ball so as to trap said ball therebetween when folded toward each other while permitting opposed parts of said ball to respectively project through said opening means at said parts of said tee member.

7. A package construction as set forth in claim 6 and further comprising at least another ball to define a plurality of balls and wherein said parts of said tee member have a plurality of said opening means therein so that said plurality of balls are packaged with said tee member in the same manner as said first-mentioned ball.

8. A package construction as set forth in claim 5 and including a ball height adjust element packaged with said tee member for being utilized at the top of said columnar means in a telescoping manner therewith for supporting said ball thereon.

* * * * *